US005101114A

United States Patent [19]

Isozumi et al.

[11] Patent Number: 5,101,114

[45] Date of Patent: Mar. 31, 1992

[54] STARTER MOTOR

[75] Inventors: Shuzou Isozumi; Toshinori Tanaka, both of Hyogo, Japan

[73] Assignee: Mitsubishi Denki K.K., Tokyo, Japan

[21] Appl. No.: 575,752

[22] Filed: Aug. 31, 1990

[30] Foreign Application Priority Data

Sep. 1, 1989 [JP] Japan ..... 1-103331[U]
Oct. 11, 1989 [JP] Japan ..... 1-118331[U]
Oct. 20, 1989 [JP] Japan ..... 1-122145[U]

[51] Int. Cl.[5] ..... F02N 15/00; F02N 15/06

[52] U.S. Cl. ..... 290/48; 74/6; 74/7 A; 310/88; 310/89

[58] Field of Search ..... 74/6, 7 R; 290/48; 310/88, 89

[56] References Cited

U.S. PATENT DOCUMENTS 4,104,926 8/1978 Wilson ..... 74/6
4,718,290 1/1988 Murata et al. ..... 74/7 A
4,808,871 2/1989 Morishita et al. ..... 310/89

FOREIGN PATENT DOCUMENTS 139859 9/1983 Japan .
20673 1/1987 Japan .

*Primary Examiner*—A. D. Pellinen
*Assistant Examiner*—Robert L. Hoover
*Attorney, Agent, or Firm*—Sughrue, Mion, Zinn, Macpeak & Seas

[57] ABSTRACT

A starter motor for an engine which does not readily admit water into a casing thereof and which allows water to be discharged promptly from the housing. The starter motor comprises a seal member for closing a gap between an outer periphery of a pinion moving member on an output rotary shaft or of an overrunning clutch and the casing, and the casing has two communicating holes formed therein for the communication with the atmospheric air outside the casing. One of the communicating holes is formed at a lower portion of the casing so that water may be discharged outwardly from within the casing therethrough. The other communicating hole is formed at a higher location of the casing and may be a communicating groove formed in an end face of a front bracket of the casing along which the front bracket is coupled to a yoke of an electric motor which is mounted in the casing and operatively coupled to the pinion moving member by way of the overrunning clutch.

10 Claims, 11 Drawing Sheets 68
69
73
60
70
59
64
58
71
51
53
72
72a
63

72a

STARTER MOTOR

BACKGROUND OF THE INVENTION

1. Field of the Invention

This invention relates to a starter motor, and more particularly to a starter motor for driving a pinion for engagement with a ring gear of an engine to start the engine.

2. Description of the Prior Art

Starter motors of the so-called overhang type are conventionally well known. An exemplary one of such starter motors is disclosed, for example, in Japanese Utility Model Laid-Open No. 6679/1986. The exemplary starter motor is shown in FIGS. 10 and 11.

Referring to FIGS. 10 and 11, the conventional starter motor of the overhand type shown includes a front bracket 1 of an outer casing or motor frame in which an opening 2 is formed. An extension or output rotary shaft 3 of an armature rotary shaft of a dc motor (not shown) disposed in the inside of the motor frame extends outwardly through the opening 2 of the front bracket 1. A pinion moving member 4 is fitted for sliding movement on and for rotation relative to the output rotary shaft 3 with a pair of bearings 5 interposed therebetween. The pinion moving member 4 is supported also for rotation and for axial sliding movement by means of a bearing 6 mounted on an inner face of the front bracket 1 adjacent the opening 2 to thus support the output rotary shaft 3 on the motor frame.

The pinion moving member 4 has a pinion 4*a* formed on an outer periphery of a front end portion (right-hand end portion in FIG. 10) thereof while a rear end thereof terminates in a clutch inner member 7*a* which is a component of an overrunning clutch device 7. Meanwhile, an outer periphery of the pinion moving member 4 between the pinion 4*a* and the clutch inner member 7*a* serves as a sliding supporting face 4*b* at which the pinion moving member 4 is supported for axial sliding movement by the bearing 6.

The overrunning clutch device 7 further includes a clutch outer member 7*b* and a plurality of rollers 7*c* for transmitting turning force from the clutch outer member 7*b* to the clutch inner member 7*a*. An oil seal 8 is fitted around the outer periphery of the pinion moving member 4 forwardly of the bearing 6. A dust protective cap 9 is removably mounted at a front end of the pinion moving member 4. A stopper 10 is mounted at an end of the output rotary shaft 3 and prevents the pinion moving member 4 from coming off from the output rotary shaft 3. A ring gear 11 of an engine, not shown, is positioned in an opposing relationship to an outer periphery of a front end portion of the output rotary shaft 3.

In operation, the overrunning clutch device 7 will be shifted forwardly in the direction of an arrow mark 12 in FIG. 10 by way of a shift lever (not shown) of a vehicle in which the engine is installed. Upon such shifting movement of the overrunning clutch device 7, also the pinion moving member 4 is slidably mounted in an integral relationship with the overrunning clutch device 7 on the output rotary shaft 3 so that the pinion 4*a* thereof extending outwardly through the opening 2 of the front bracket 1 is brought into meshing engagement with the ring gear 11 of the engine as shown in FIG. 11. The dc motor is energized just before the pinion 4*a* is brought into meshing engagement with the ring gear 11, and rotation of the armature rotary shaft thereof is transmitted from the clutch outer member 7*b* to the clutch inner member 7*a* by way of the rollers 7*c* of the overrunning clutch device 7 to rotate the pinion moving member 4 to start the engine by way of the pinion 4*a* and the ring gear 11.

When the pinion moving member 4 is rotated at a high speed by the engine after starting of the engine but before returning of the pinion moving member 4 in the direction opposite to the direction of the arrow mark 12 to its home position by a spring means, not shown, the clutch inner member 7*a* of the overrunning clutch device 7 is rotated at a higher speed than the clutch outer member 7*b*. Consequently, the rollers 7*c* are brought out of meshing engagement with the clutch inner member 7*a* and the clutch outer member 7*b* to allow the clutch inner member 7*a* to rotate idly with respect to the clutch outer member 7*b*. Thus, the overrunning clutch device 7 serves as a one-way clutch which has a function to transmit turning force only in one of the two opposite directions, and high speed rotation of the pinion moving member 4 is not transmitted to the dc motor.

While the oil seal 8 serving as a waterproof and dust tight structure of the starter motor is not described in detail in Japanese Utility Model Laid-Open No. 6679/1986 mentioned hereinabove, such a conventional oil seal as shown in FIG. 12 may be employed as the oil seal 8. Referring to FIG. 12, the conventional oil seal 8 shown includes a mounting ring 8*a* made of iron and having a substantially L-shaped cross section, and a rubber seal element 8*b* having a V-shaped cross section and securely mounted on an inner periphery of the mounting ring 8*a*. As apparently seen in FIG. 12, the oil seal 8 having such construction as described just above is mounted by force fitting on an inner periphery of the opening 2 of the front bracket 1 which is formed axially outwardly of and has a smaller diameter than another inner periphery of the opening 2 of the front bracket 1 in which the bearing 6 is fitted. The oil seal 8 is spaced forwardly from the bearing 6, and the opening side of the V-shaped seal element 8*b* is directed outwardly of the opening 2 while a radially inward lip portion 8*c* thereof is held in contact with the outer periphery of the pinion moving member 4.

A conventional starter motor of the overhand type which includes such a waterproof and dust tight structure as described above has a drawback that water is likely to gather in the V-shaped seal element 8*b* of the oil seal 8. Particularly where the starter motor is mounted in a vertical orientation on an engine such that the pinion 4*a* is located upwardly while the dc motor is located downwardly, water may be received in the V-shaped seal element 8*b*. Once water gathers in the seal element 8*b* of the oil seal 8 in this manner, it will readily advance into the inside of the front bracket 1 due to a breathing action by heat or due to vibrations and will thus cause rust on the bearing 6 which may be in the form of a ball bearing. Such rust will deteriorate sliding movement of the pinion moving member 4 with respect to the output rotary shaft 3 coupled to the dc motor. Or worse, water may advance into the inside of the dc motor and cause a failure in operation of the dc motor.

A starter motor is also conventionally known which is constructed such that water which eventually gathers in the motor is removed from within the motor by way of a water drain hole. The starter motor of the type just mentioned is shown in FIG. 13. Referring to FIG. 13, the starter motor shown includes a motor body 51 composed of an armature 52, an armature rotary shaft 53, a plurality of field coils 54, a plurality of armature coils 55, a plurality of magnetic poles 56, a yoke 57 and so forth. A pinion 58 for engaging with a ring gear (not shown) of an engine (not shown) is mounted on an output rotary shaft 59 which may be in the form of a forward extension of or may be coupled to the armature rotary shaft 53. The pinion 58 is operatively coupled to the output rotary shaft 59 by way of an overrunning clutch device 60 which includes a clutch outer member 61 and a clutch inner member 62 formed in an integral relationship with the pinion 58. A rear end portion of the armature rotary shaft 53 is supported for rotation on a rear bracket 63 by way of a bearing 65 while a front end portion of the output rotary shaft 59 is supported for rotation on a front bracket 64 by way of another bearing 66. A sleeve bearing 67 is interposed between the pinion 58 and the output rotary shaft 59. An electromagnetic switch 68 is disposed in parallel to the armature rotary shaft 54 and actuates, upon closing of a starter switch not shown, a shift lever 69 to push the pinion 58 axially outwardly of the motor body 51 and close contacts, not shown, to supply electric power to the motor body 51.

The rear bracket 63 and the front bracket 64 cooperate to form an outer casing which surrounds the motor body 51 together with the yoke 57, and an oil seal 70 for waterproofing is interposed between the front bracket 64 and the overrunning clutch device 60 while a radial water discharging hole 71 is formed in the front bracket 64 forwardly of the oil seal 70.

With this starter motor, even if water comes to a location around the pinion 58 from the engine side, it is prevented from advancing into the inside of the starter motor by the oil seal 70 on the outer periphery of the overrunning clutch device 60 or pinion 58 and is discharged by way of the water discharging hole 71.

However, if water comes to a location around the pinion 58 from a transmission side of the engine when the motor body 51 is in a high temperature condition, water is sometimes admitted into the outer casing of the starter motor due to a capillary phenomenon along the overrunning clutch device 60. Consequently, water gathers around the motor body 51 and causes rust on the motor body 51, which will deteriorate operation of the starter motor.

In order to discharge water which may possibly gather in the inside of the outer casing of the starter motor, a water drain hole 72 is formed at a lower or bottom portion of a side wall of the outer casing, that is, the rear bracket 63. Actually, however, such water drain hole 72 is not very effective to discharge water gathering in the inside of the starter motor. Or rather, splashed water may be admitted into the inside of the starter motor by way of the water drain hole 72, resulting in deterioration in operation of the starter motor.

In the case of the starter motor which is mounted on the engine in a horizontal orientation wherein the axis of the armature rotary shaft 53 extends in a horizontal direction, the water drain hole 72 is formed at a bottom portion of the side wall of the rear bracket 63 as described above. However, where the starter motor is mounted in a vertical orientation wherein the axis of the armature rotary shaft 53 extends in a vertical direction as shown in FIG. 14, the water drain hole 72 is conventionally formed at a different bottom portion, that is, at an axial end wall of the rear bracket 63 as shown in FIG. 14. Also the arrangement is not effective to prevent the motor body from being wet with water admitted into the inside of the starter motor from the transmission side.

SUMMARY OF THE INVENTION

Accordingly, it is an object of the present invention to provide a starter motor which can effectively prevent water from being admitted into the inside thereof whether a pinion moving member is in a rest position or in an operative position irrespective of an orientation of the starter motor mounted on an engine.

It is another object of the present invention to provide a starter motor which does not readily admit water into the inside of an outer casing thereof even if the temperature of a motor body rises and which can discharge water promptly from the inside of the outer housing.

It is a further object of the present invention to provide a starter motor which is simple in construction and easy to produce and can effectively prevent a motor body from being wet with water admitted into the inside of the starter motor from a transmission side of an engine on which the starter motor is mounted.

In order to attain the objects, according to one aspect of the present invention, there is provided a starter motor for starting an engine, which comprises a casing including a front bracket and a rear bracket, an output rotary shaft mounted for rotation in the casing, an electric motor accommodated in the casing for rotating the output rotary shaft, a bearing mounted on the front bracket, the front bracket having an opening formed therein, a pinion moving member mounted for rotation and for axial sliding movement on the output rotary shaft and supported at an outer periphery thereof for axial sliding movement on the bearing and also for rotation on the front bracket by way of the bearing, the pinion moving member extending outwardly through the opening of the front bracket, an overrunning clutch for coupling the output rotary shaft to the pinion moving member, the pinion moving member having a pinion formed at a front end portion thereof such that, when the pinion moving member is moved outwardly in an axial direction from its rest position, the pinion is operatively coupled to the engine to start the engine, an annular seal member mounted in the opening of the front bracket and extending radially inwardly and generally axially outwardly from the front bracket to form a lip portion, and a flange member securely mounted on the outer periphery of the pinion moving member such that, when the pinion moving member is at its rest position, the lip portion of the annular seal member contacts with the flange member to close the opening of the front bracket, the rear bracket having a water drain hole formed at a location thereof opposite to the opening of the front bracket for discharging water from the inside of the casing, the casing having an atmosphere communicating hole formed at a suitable location thereof for preventing admission of water into the inside of the casing but permitting passage only of air therethrough.

With the starter motor, when the pinion moving member is at its rest position, the lip portion of the annular seal member mounted in the opening of the front bracket of the casing contacts with the flange member to close the opening of the front bracket. Consequently, even where the starter motor is mounted in a vertical orientation wherein the output rotary shaft extends in a vertical direction and the pinion is positioned upwardly, water coming from above to the starter motor is prevented from advancing into the inside of the casing along the outer periphery of the pinion moving member. Besides, even if water is admitted into the inside of the casing of the starter motor, such water is promptly discharged outwardly by way of the water drain hole due to presence of the atmosphere communicating hole.

According to another aspect of the present invention, there is provided a starter motor for starting an engine, which comprises a casing including a front bracket and a rear bracket, an output rotary shaft mounted for rotation in the casing, an electric motor accommodated in the casing for rotation the output rotary shaft, a bearing mounted on the front bracket, the front bracket having an opening formed therein, a pinion moving member mounted for rotation and for axial sliding movement on the output rotary shaft and supported at an outer periphery thereof for axial sliding movement on the bearing and also for rotation on the front bracket by way of the bearing, the pinion moving member extending outwardly through the opening of the front bracket, an overrunning clutch for coupling the output rotary shaft to the pinion moving member, the pinion moving member having a pinion formed at a front end portion thereof such that, when the pinion moving member is moved outwardly in an axial direction from its rest position, the pinion is operatively coupled to the engine to start the engine, and an annular seal member mounted in the opening of the front bracket and extending radially inwardly to form a lip portion which is held in normal contact with the outer periphery of the pinion moving member, the rear bracket having a water drain hole formed at a location thereof opposite to the opening of the front bracket for discharging water from the inside of the casing, the casing having an atmosphere communicating hole formed at a suitable location thereof for preventing admission of water into the inside of the casing but permitting passage only of air therethrough.

With the starter motor, the lip portion of the annular seal member mounted in the opening of the front bracket of the casing remains in normal contact with the flange member to close the opening of the front bracket. Consequently, even where the starter motor is mounted in a vertical orientation wherein the output rotary shaft extends in a vertical direction and the pinion is positioned upwardly, water coming from above to the starter motor is prevented from advancing into the inside of the casing along the outer periphery of the pinion moving member. Besides, even if water is admitted into the inside of the casing of the starter motor, such water is promptly discharged outwardly by way of the water drain hole due to presence of the atmosphere communicating hole.

According to a further aspect of the present invention, there is provided a starter motor for starting an engine, which comprises a casing including a front bracket and a rear bracket, an output rotary shaft mounted for rotation in the casing, the starter motor being mounted on the engine in a vertical orientation wherein the output rotary shaft extends in a vertical direction and the front and rear brackets are positioned upwardly and downwardly, respectively, an electric motor accommodated in the casing for rotating the output rotary shaft and having a yoke which serves as part of the casing, a pinion moving member mounted for rotation and for axial sliding movement on the output rotary shaft and also in the front bracket and having a pinion formed at an outer end portion thereof, an overrunning clutch for coupling the output rotary shaft to the pinion moving member, a shift lever mounted at a supporting portion of the front bracket in the casing for moving the pinion moving member in the opposite axial directions, an electromagnetic switch located in a juxtaposed relationship with the electric motor in the casing for controlling energization of the electric motor and operating the shift lever to move the pinion moving member axially to and from a position in which the pinion thereof is operatively coupled to the engine to start the engine, and a seal member for closing a gap between an outer periphery of the overrunning clutch and the front bracket, the rear bracket having a water drain hole formed at a lower portion thereof such that water may be discharged downwardly through the water drain hole, the front bracket having a communicating groove formed in an end face thereof adjacent the supporting portion such that the inside and the outside of the yoke of the electric motor are communication with each other by way of the communicating groove.

With the starter motor, the communicating groove which communicates the inside and the outside of the yoke with each other prevents the inside of the yoke from being put into a negative pressure condition. Consequently, admission of water into the inside of the casing due to a capillary phenomenon along the seal member is prevented. Further, even if water is admitted into the casing, such water is promptly discharged outwardly by way of the water drain hole. Besides, the structure for minimizing a possible bad influence of water which may be admitted into the inside of the casing from the engine side can be produced readily, for example, by forming directly in a front bracket by die-casting a communicating hole or groove which communicates the inside and the outside of the casing.

According to a still further aspect of the present invention, there is provided a starter motor for starting an engine, which comprises a casing, an output rotary shaft mounted for rotation in the casing, an electric motor accommodated in the casing for rotating the output rotary shaft, a pinion moving member mounted for rotation and for axial sliding movement on the output rotary shaft and also in the front bracket and having a pinion formed at an outer end portion thereof, an overrunning clutch accommodated in the casing for coupling the output rotary shaft to the pinion moving member, an electromagnetic switch for controlling energization of the electric motor and moving the pinion moving member axially to and from a position in which the pinion of the pinion moving member is operatively coupled to the engine to start the engine, and a seal member for closing a gap between an outer periphery of the overrunning clutch and the casing, the casing having at least two communicating holes formed therein for the communication with the atmospheric air outside the casing, one of the communicating holes being formed at a lower portion of the casing in such a manner as to be directed downwardly.

With the starter motor, even if the temperature of the electric motor rises or lowers, admission of water into the casing is prevented or minimized since air in the casing communicates with the atmospheric air outside the casing. Further, even if water is admitted into the casing, it is promptly discharged outwardly by way of the downwardly directed communicating hole due to presence of another one of the communicating holes which communicates with the atmospheric air outside the casing. Also splashed water which may be admitted into the casing is also discharged promptly.

The above and other objects, features and advantages of the present invention will become apparent from the following description and the appended claims, taken in conjunction with the accompanying drawings in which like parts are denoted by like reference characters all through the drawings.

DESCRIPTION OF THE PREFERRED EMBODIMENTS

Figure 1:
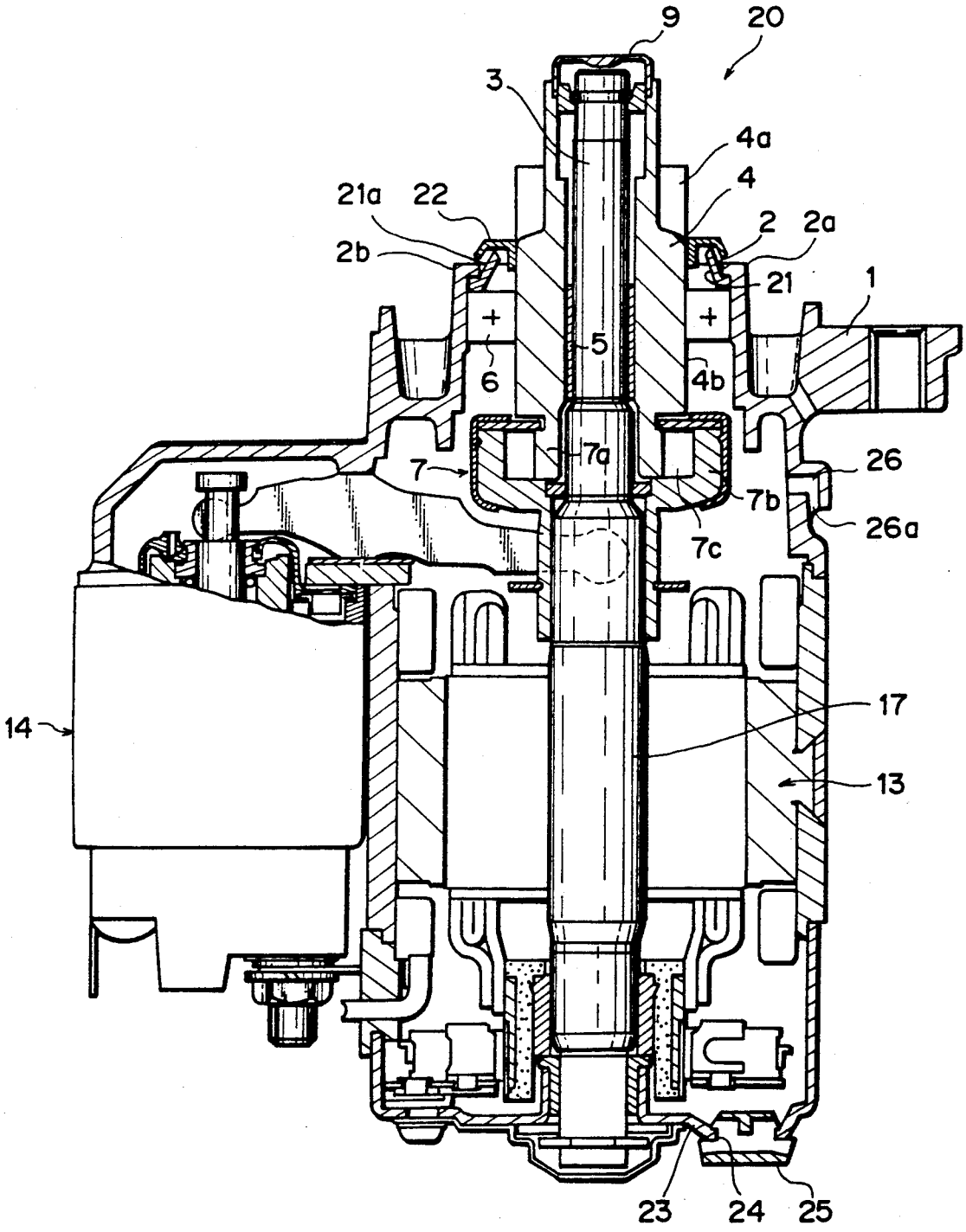
FIG. 1 is an axial sectional view of a starter motor mounted in a vertical orientation showing a first preferred embodiment of the present invention.
Figure 10:
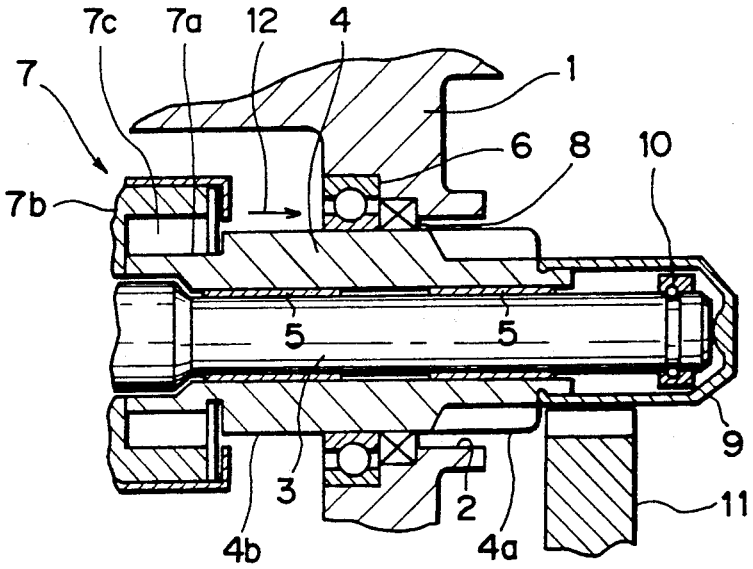
FIG.10 PRIOR ART
FIG. 10 is an axial sectional view of part of a conventional starter motor.
Figure 11:
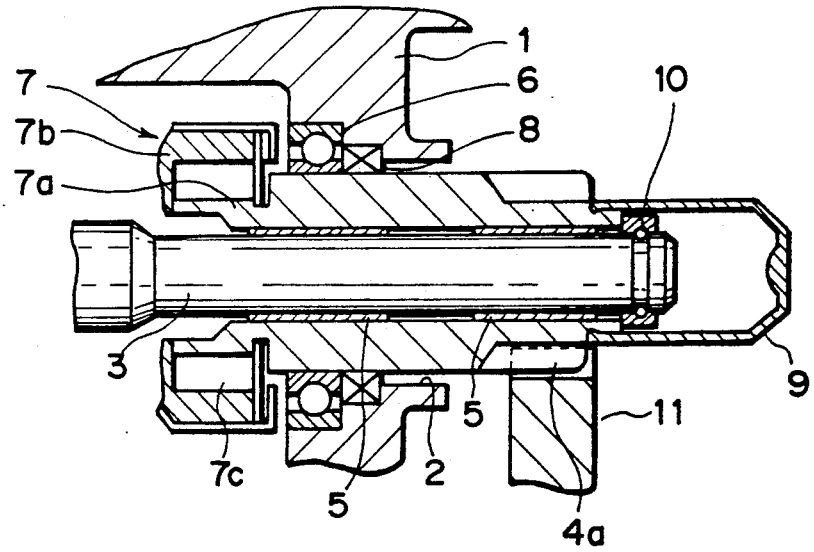
FIG.11 PRIOR ART
FIG. 11 is a similar view but showing the starter motor of FIG. 10 in a different position in which a pinion moving member is at a forwardly moved position.
Figure 12:
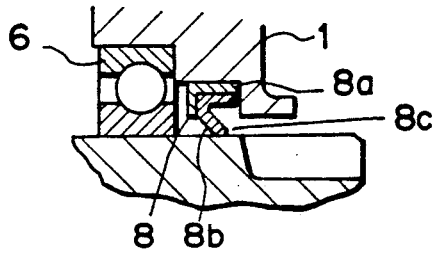
FIG.12 PRIOR ART
FIG. 12 is a partial enlarged sectional view showing an oil seal of the conventional starter motor of FIG. 10.

Referring first to FIG. 1, there is shown a starter motor to which the present invention is applied. The starter motor has somewhat similar construction to that of the conventional starter motor described hereinabove with reference to FIGS. 10 to 12, and detailed description of such common construction is omitted herein to avoid redundancy.

The starter motor is generally denoted at 20 and is mounted in a vertical orientation on an engine, not shown. The starter motor 20 includes a front bracket 1 having an opening 2 formed at an upper wall thereof through which a pinion moving member 4 can pass. A radially inwardly extending flange 2*a* is formed over an entire circumference on an inner periphery of the opening 2 of the front bracket 1. An annular oil seal 21 is interposed between the flange 2*a* of the front bracket 1 and a bearing 6 force fitted in the opening 2. The annular oil seal 21 is fixedly held along an outer periphery thereof between the bearing 6 and a lower face of the flange 2*a* of the front bracket 1. The annular oil seal 21 extends radially inwardly and is intermediately bent axially outwardly, that is, axially upwardly, to provide a lip portion 21*a* as seen in FIG. 1. The annular oil seal 21 is cut out at a circumferential portion thereof together with an axial or upper end face of the front bracket 1, along which the opening 2 is defined, to form a water discharging groove 2*b*.

A flange member 22 having a channel-shaped cross section is mounted over an entire circumference on a sliding supporting face 4*b* of the pinion moving member 4. The flange member 22 is secured by suitable means such as force fitting at a location of the pinion moving member 4 such that, when the pinion moving member 4 is at its normal rest or inoperative position shown in FIG. 1, the lip portion 21*a* of the oil seal 21 extends into the inside of the channel-shape of the flange member 22 and contacts with an inner bottom face of the channel-shape member 22 as shown in FIG. 1.

A water drain hole 24 is formed in a bottom wall or axially lower wall of a rear bracket 23 which constitutes an outer casing together with the front bracket 1, and a grommet 25 for draining water from within the outer casing but preventing admission of water from the outside of the outer casing of the starter motor is fitted in the water drain hole 24.

In order to allow water to be discharged from the inside of the outer casing of the starter motor by way of the water drain hole 24 of the rear bracket 23, it is necessary to keep the inside of the outer casing in communication with the atmospheric air outside the outer casing at some other location of the outer casing. To this end, an atmosphere communicating hole 26 is formed in a side wall of the front bracket 1. Since the starter motor 20 is mounted and used in a vertical orientation wherein the front bracket 1 is located upwardly while the rear bracket 23 is located downwardly as shown in FIG. 1, an outer opening 26*a* of the atmosphere communicating hole 26 is directed downwardly so that water may not be admitted into the inside of the outer casing by way of the atmosphere communicating hole 26.

It is to be noted that reference numeral 13 in FIG. 1 denotes a motor body of a dc motor, 14 an electromagnetic switch device, and 17 an armature rotary shaft of the dc motor. The output rotary shaft 3 is either an extension of the armature rotary shaft 17 of the dc motor or coupled to the armature rotary shaft 17.

When the starter motor 20 is mounted in position on the engine, not shown, the opening 2 of the front bracket 1 through which the pinion moving member 4 can be axially advanced and retracted in vertical directions is closed completely by the flange member 22 and the oil seal 21. Accordingly, when the starter motor 20 is in a rest condition, admission of water or dust into the inside of the outer casing of the starter motor can be prevented effectively. On the other hand, when the starter motor 20 is moved axially outwardly to an operative condition so that the pinion moving member 4 is projected axially upwardly into meshing engagement with a ring gear (not shown) of the engine, the flange member 22 is spaced upwardly from the lip portion 21*a* of the oil seal 21. According, water may be admitted into the inside of the outer casing by way of a gap between the flange member 22 and the oil seal 21. Such water thus admitted in will pass through the opening 2 of the front bracket 1 and then along the sliding supporting face 4*b* of the pinion moving member 4 and then through between the bearing 6 and the pinion moving member 4 into the inside of the outer casing. However, water admitted into the inside of the starter motor 20 in this manner will be discharged promptly to the outside by way of the water drain hole 24.

Thus, it is apparent that, if water comes to the starter motor 20, only while the pinion moving member 4 is in its normal rest position when a vehicle on which the engine is carried is operating, admission of water into the inside of the starter motor 20 can be prevented perfectly.

Figure 2:
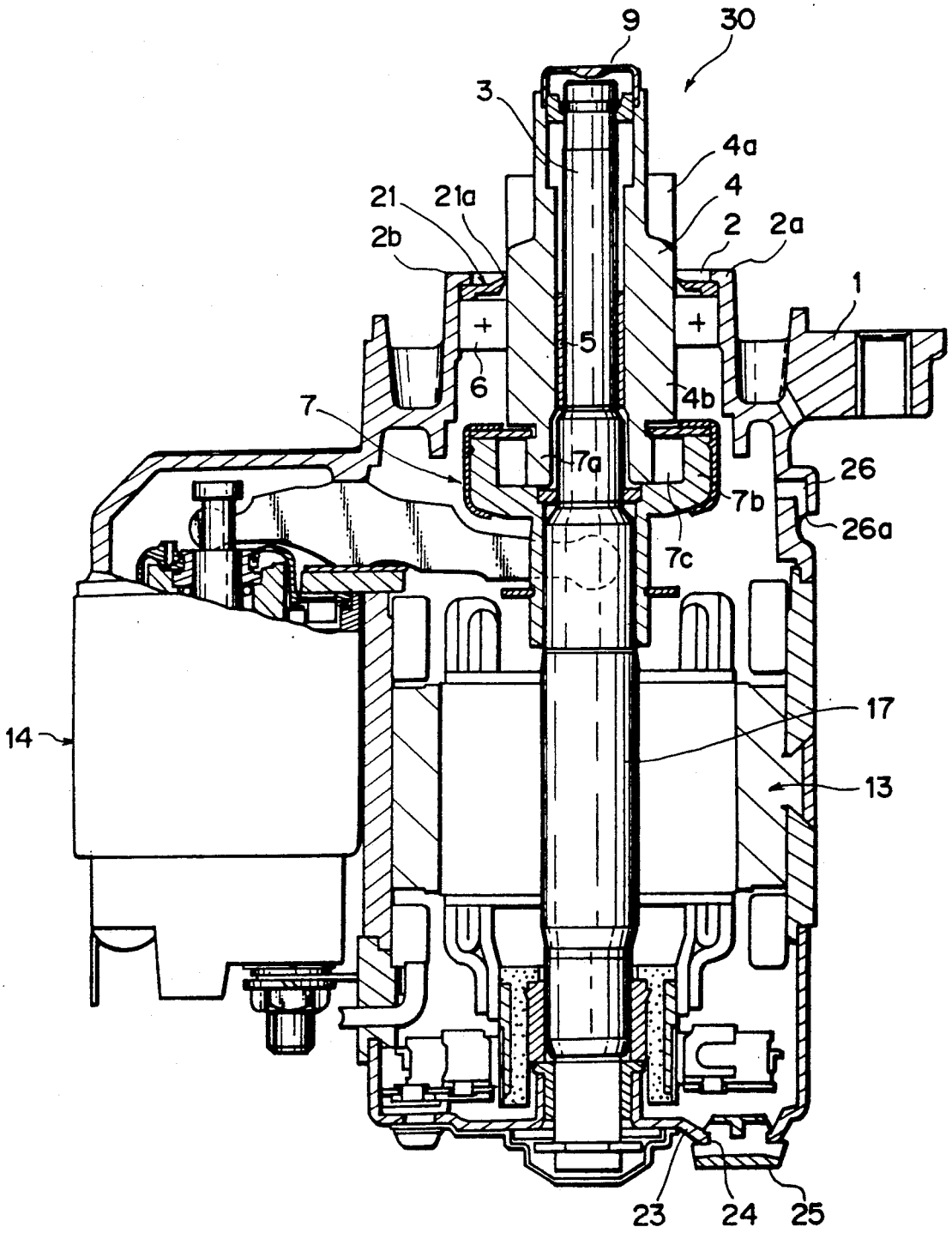
FIG. 2 is a similar view but showing a modification to the starter motor of FIG. 1.

Referring now to FIG. 2, there is shown a modification to the starter motor shown in FIG. 1. The modified starter motor is generally denoted at 30 and is only different in construction from the starter motor 20 described hereinabove with reference to FIG. 1 in that the flange member 22 is omitted and the lip portion 21*a* of the oil seal 21 is normally held in direct contact with the sliding support face 4*b* of the pinion moving member 4.

With the modified starter motor, whether the pinion moving member 4 is in its normal inoperative position or in its operative position in which it projects axially outwardly from the front bracket 1 and the pinion 4*a* thereof meshes with the ring gear (Not shown) of the engine on which the starter motor is mounted, the lip portion 21*a* of the oil seal 21 is always held in contact with the sliding supporting face 4*b* of the pinion moving member 4. Consequently, the opening 2 of the front bracket 1 is closed perfectly, and accordingly, admission of water or dust can be prevented perfectly. Even if water should be admitted into the inside of the outer casing of the starter motor 30, it can be discharged promptly from the inside of the starter motor 30 by way of the water drain hole 24 formed in the rear bracket 23 as described hereinabove.

Figure 3:
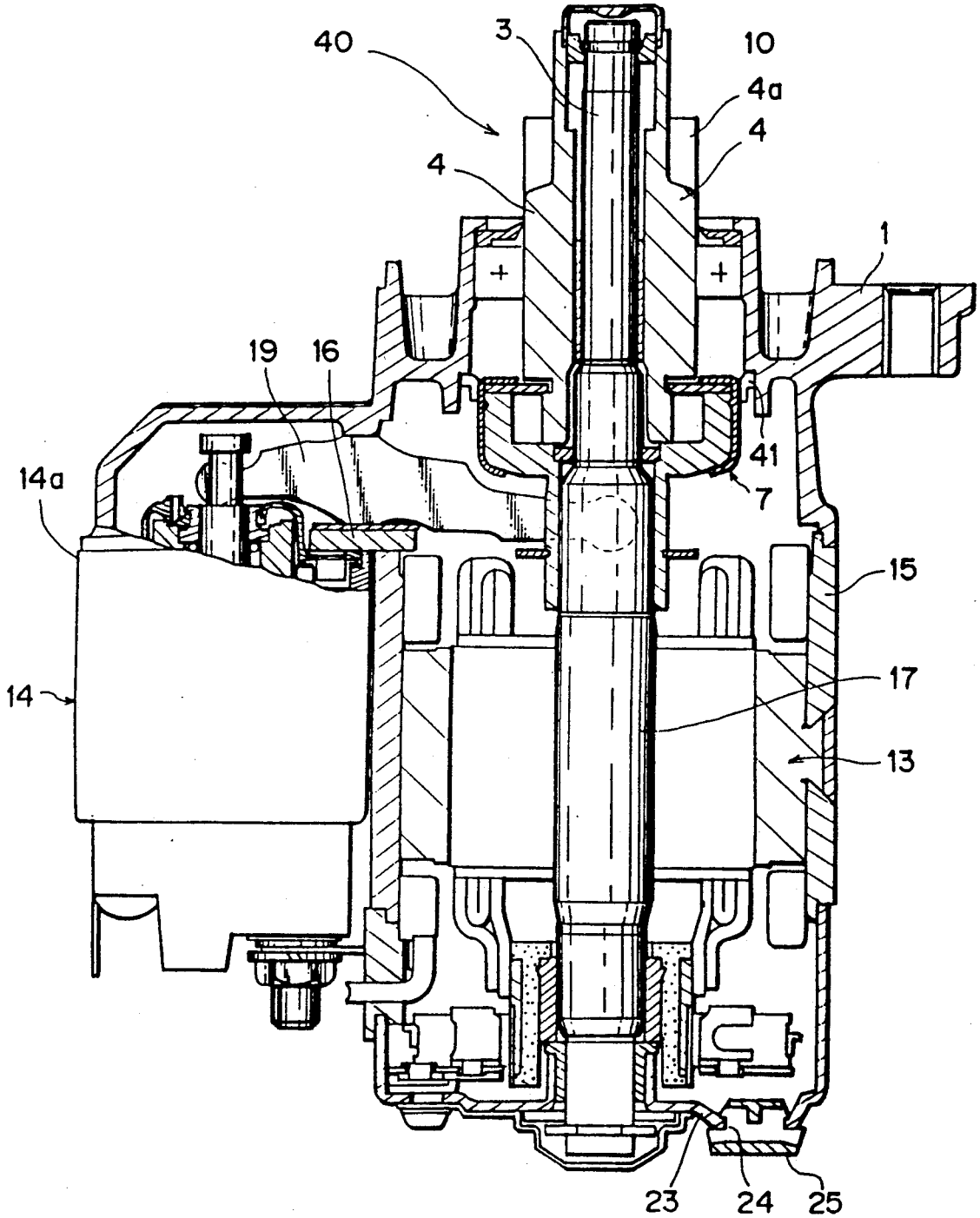
FIG. 3 is an axial sectional view of a modification to the modified starter motor of FIG. 2.
Figure 4:
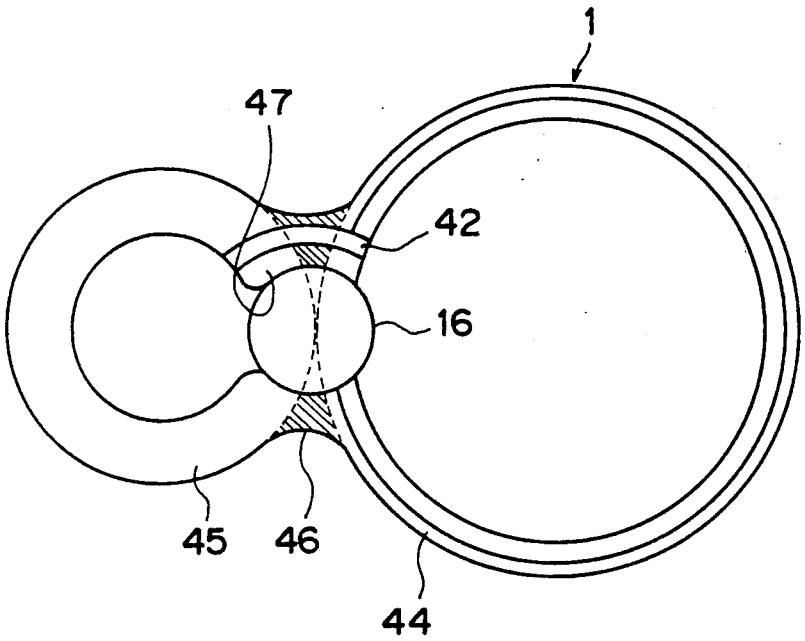
FIG. 4 is a bottom plan view of a front bracket of the starter motor shown in FIG. 3.

Referring now to FIGS. 3 and 4, there is shown a modification to the modified starter motor shown in FIG. 2. The further modified starter motor is generally denoted at 40 and is different in construction from the starter motor of FIG. 2 in that an additional oil seal 41 is interposed between the front bracket 1 and the overrunning clutch device 7 and a communicating groove 42 is formed in place of the atmosphere communicating hole 26 formed in the front bracket 1 as described below.

In particular, the motor body 13 includes a yoke 15 which cooperates with the front bracket 1 and the rear bracket 23 to constitute the outer casing or motor frame. The yoke 15 of the motor 13 is mounted on the front bracket 1 such that an upper end face thereof presses against and compresses a packing 16 which cooperates with the front bracket 1 to support a shift lever 19 for pivotal motion around a fixed point in the starter motor and protects a pivotally supported portion of the shift lever 19 against water. Also the electromagnetic switch device 14 is mounted on the front bracket 1 such that a casing 14*a* thereof presses, at an upper end face thereof, against and compresses the packing 16.

Referring particularly to FIG. 4, there is shown a relationship between the packing 16 and the front bracket 1. The front bracket 1 is shown in a bottom end view and has an annular portion 44 at which it contacts with and is connected to the upper end of the yoke 15 of the motor body 13. The front bracket 1 further has another annular portion 45 at which it contacts with and is connected to the upper end of the casing 14*a* of the electromagnetic switch device 14. Accordingly, portions 46 of the front bracket 1 indicated by meshes are exposed to the external air outside the outer casing of the starter motor 40. The communicating groove 42 is formed on the lower end face of the front bracket 1 and extends between inner peripheries of the annular portions 44 and 45 through one of the externally exposed portions 46 so that the inside and the outside of the yoke 15 and the inside and the outside of the casing 14*a* of the electromagnetic switch device 14 may be communicated with each other by way of the communicating groove 42.

With the modified starter motor 40, the structure for minimizing a possible bad influence of water which may be admitted into the inside of the outer casing from the transmission side of the engine can be produced readily, for example, by forming directly in a front bracket by die-casting a communicating hole or groove which communicates the inside and the outside of the outer casing.

It is to be noted that, while the oil seal 21 in the starter motors 20, 30 and 40 of the embodiment and modifications described above may be of any type including an oil seal having a spring accommodated therein, the oil seal in the present invention is not limited to such oil seals but may be any seal member other than such oil seals.

Figure 5:
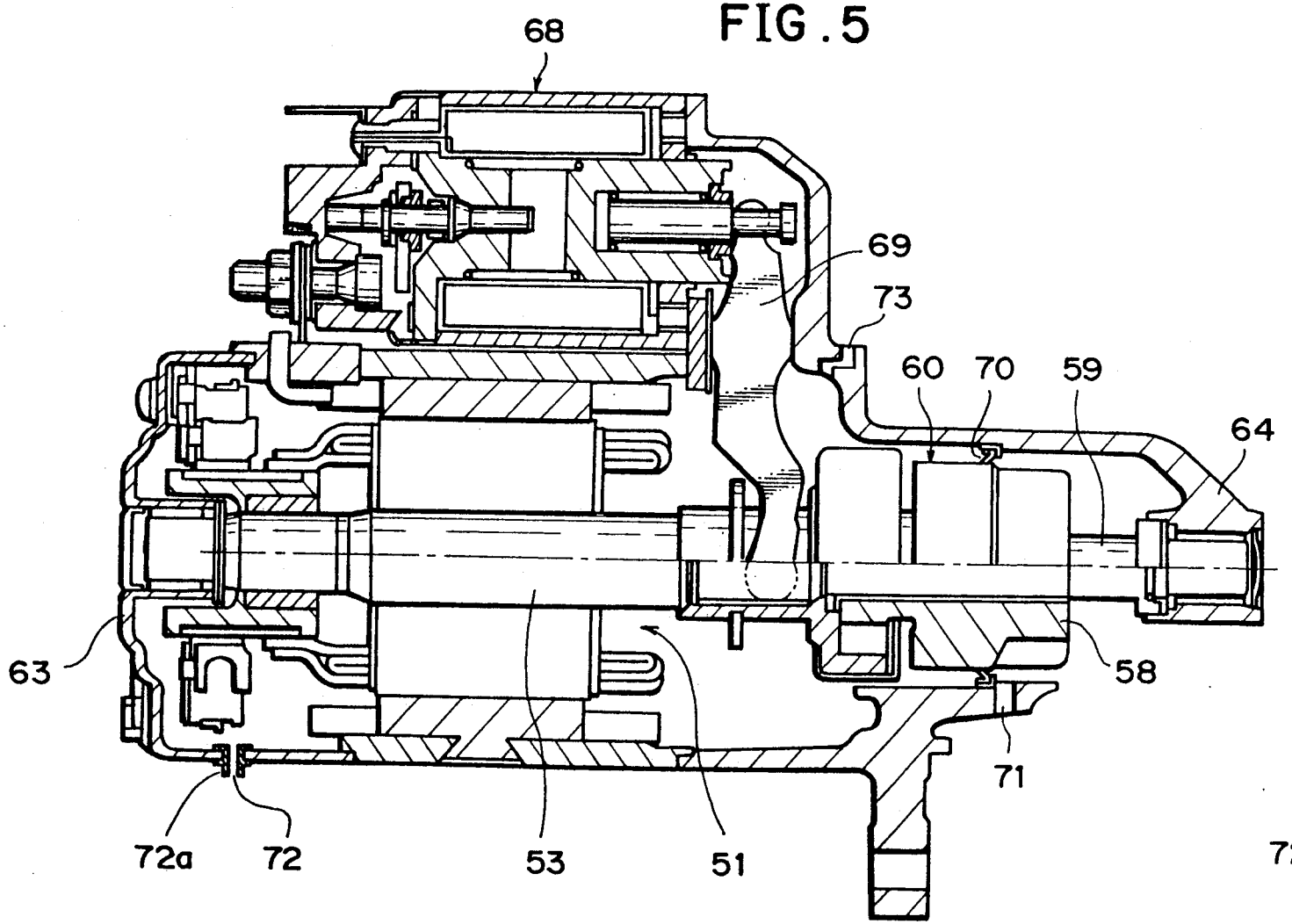
FIG. 5 is an axial sectional view of a starter motor mounted in a horizontal orientation showing a second preferred embodiment of the present invention.
Figure 13:
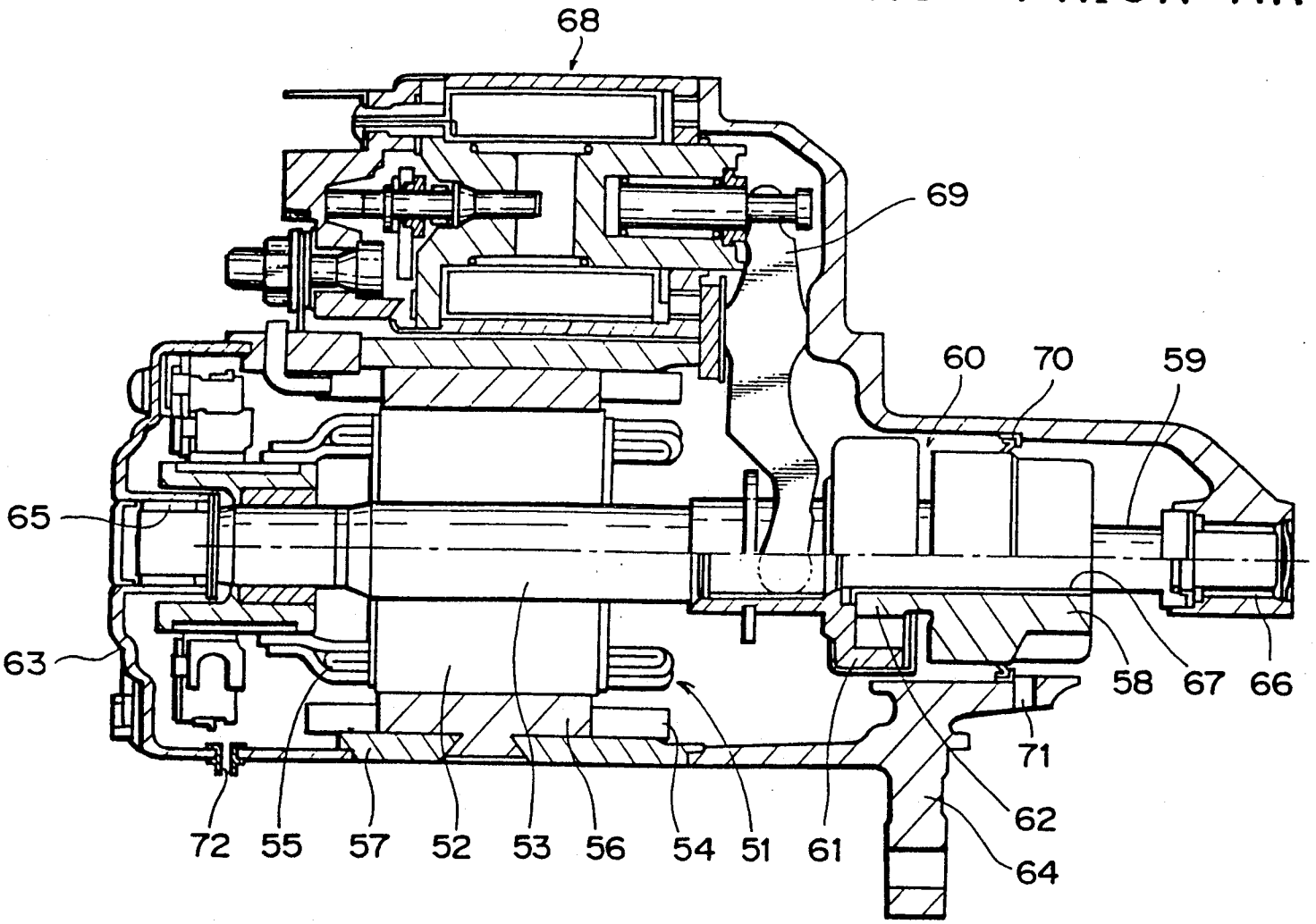
FIG. 13 PRIOR ART
FIG. 13 is an axial sectional view showing another conventional starter motor mounted in a horizontal orientation.
Figure 14:
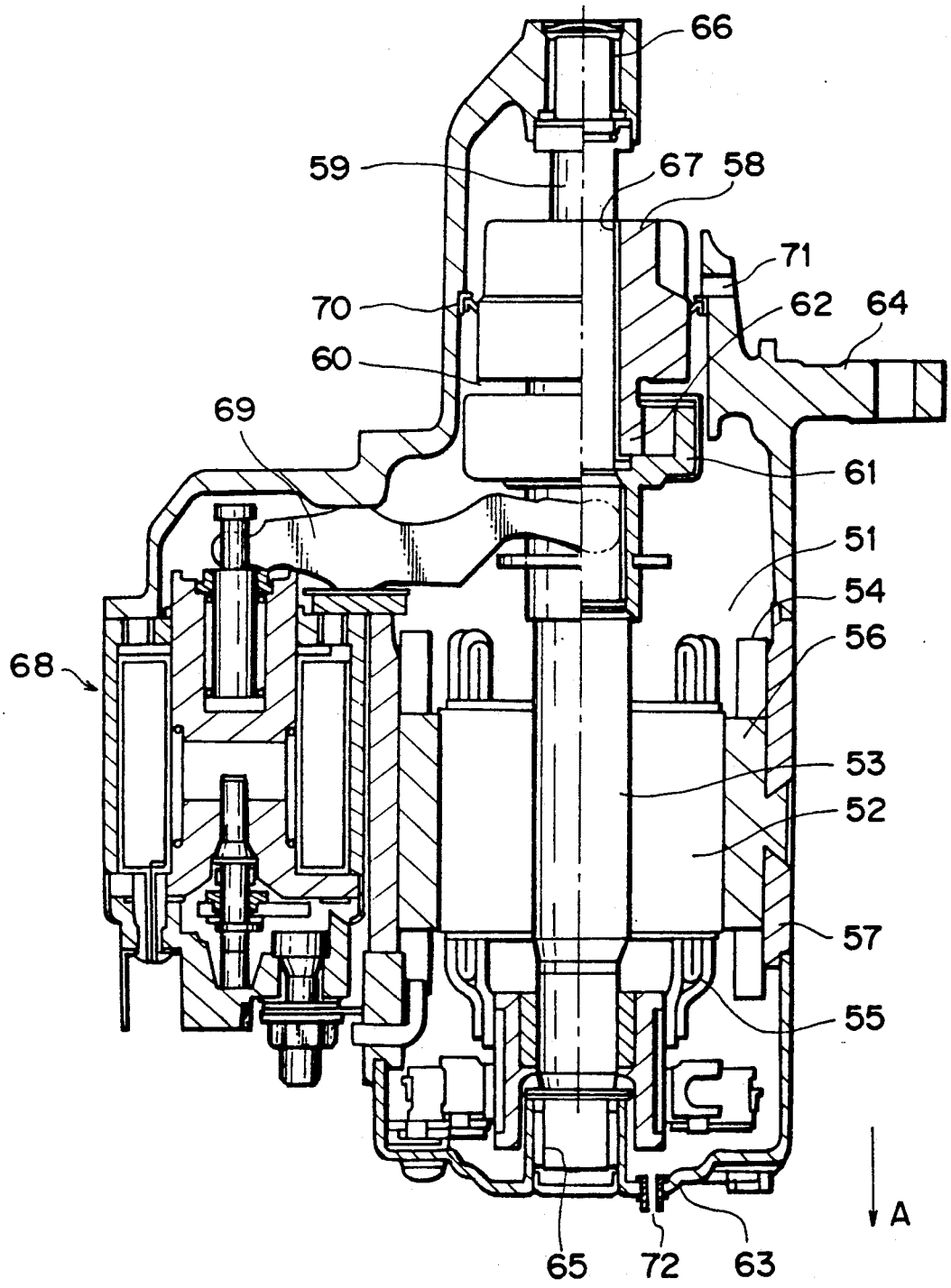
FIG.14 PRIOR ART
FIG. 14 is an axial sectional view but showing a further conventional starter motor mounted in a vertical orientation.

Referring now to FIG. 5, there is shown a starter motor according to a second preferred embodiment of the present invention. The starter motor has somewhat similar construction to that of the conventional starter motor described hereinabove with reference to FIG. 13, and detailed description of such common construction is omitted herein to avoid redundancy.

The starter motor shown is mounted on an engine, not shown, in a horizontal orientation wherein an armature rotary shaft 53 and an output rotary shaft 59 extend in a substantially horizontal direction. A front bracket 64 which cooperates with a rear bracket 63 to form an outer casing has a communicating hole 73 formed at an upper portion thereof for communicating the inside of the outer casing with the outside atmospheric air. Meanwhile, a water drain hole 72 is formed at a bottom portion of the rear bracket 63 by means of a tube or grommet 72*a* and extends downwardly toward the ground.

With the starter motor, even if the temperature of a motor body 51 rises or lowers, water will not be sucked into the inside of the outer casing along a pinion 58 or an overrunning clutch device 60 because the inside of the outer casing communicates with the outside atmospheric air by way of the communicating hole 73 in the front bracket 64 and the water drain hole 72 formed in the rear bracket 63.

On the other hand, even if water should be admitted into the inside of the outer casing, since the inside of the outer casing communicates with the outside atmospheric air by way of upper and lower holes, that is, by way of the communicating hole 73 and the water drain hole 72, such water will be discharged outside promptly by way of the water drain hole 72 without remaining in the inside of the outer casing. Even if splashed water is admitted in by way of the water drain hole 72, it will be discharged similarly by way of the water drain hole 72.

Figure 6:
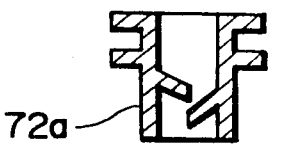
FIG. 6 is a sectional view of a water drain hole defining member of the starter motor of FIG. 5.

It is to be noted that the tube 72*a* in which the water drain hole 72 is defined is preferably in the form of a labyrinth type tube 72*a* as shown in FIG. 6. This is because the labyrinth type tube 72*a* will effectively prevent admission of splash water or water from below.

Figure 7:
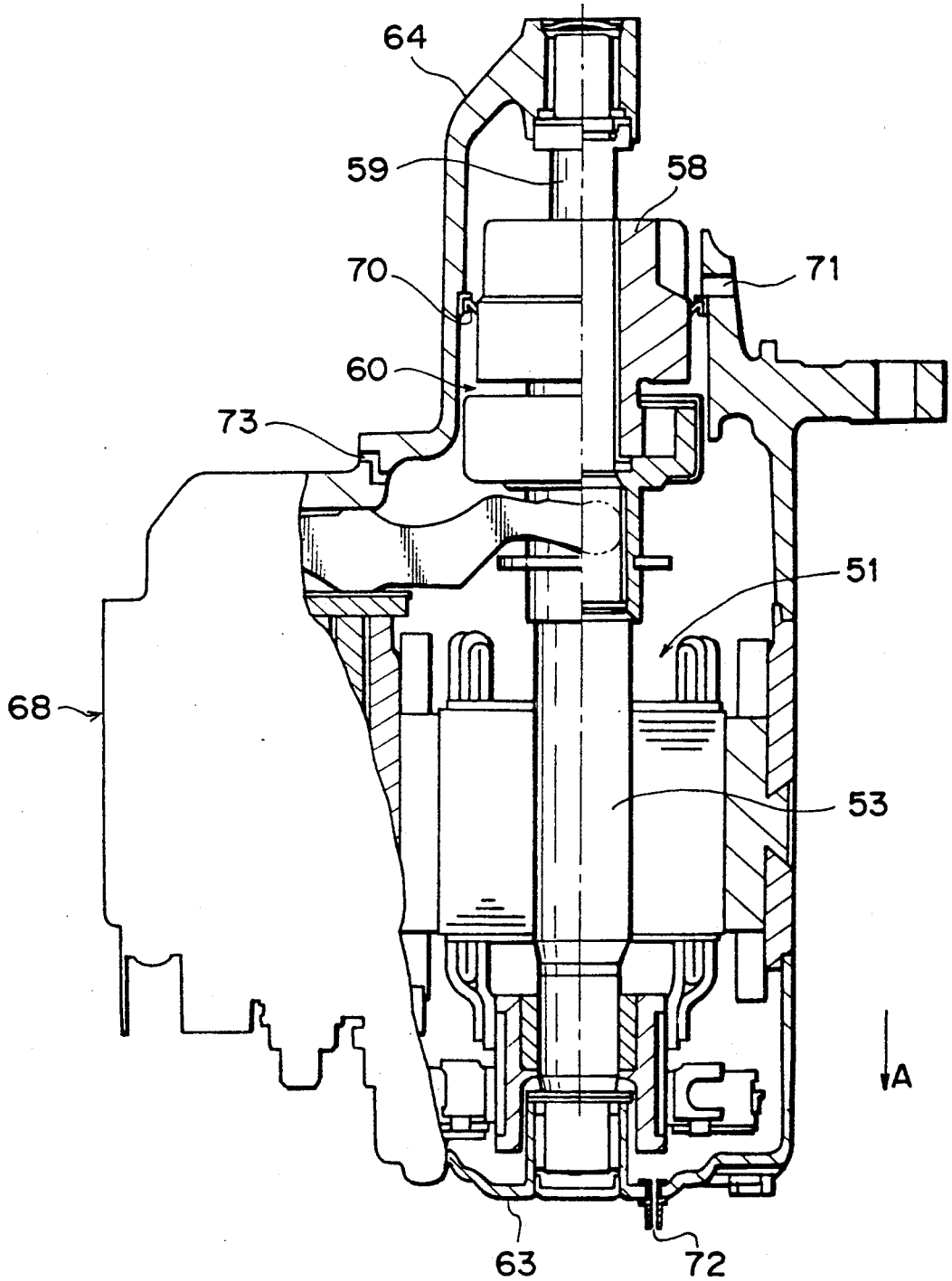
FIG. 7 is an axial sectional view of a modification to the starter motor of FIG. 5.

Referring now to FIG. 7, there is shown a modification to the starter motor of the embodiment shown in FIG. 5. The modified starter motor is different in construction from the starter motor of the embodiment shown in FIG. 5 in that it is mounted in a vertical orientation wherein the armature rotary shaft 53 extends in a vertical direction relative to the ground, as indicated by an arrow mark A, and the pinion 58 is located upwardly. Accordingly, the water drain hole 72 is formed in an axial end wall of the rear bracket 63 which now serves as a bottom wall.

Also with the modified starter motor, similar effects can be attained to those of the starter motor of the embodiment shown in FIG. 5.

Figure 8:
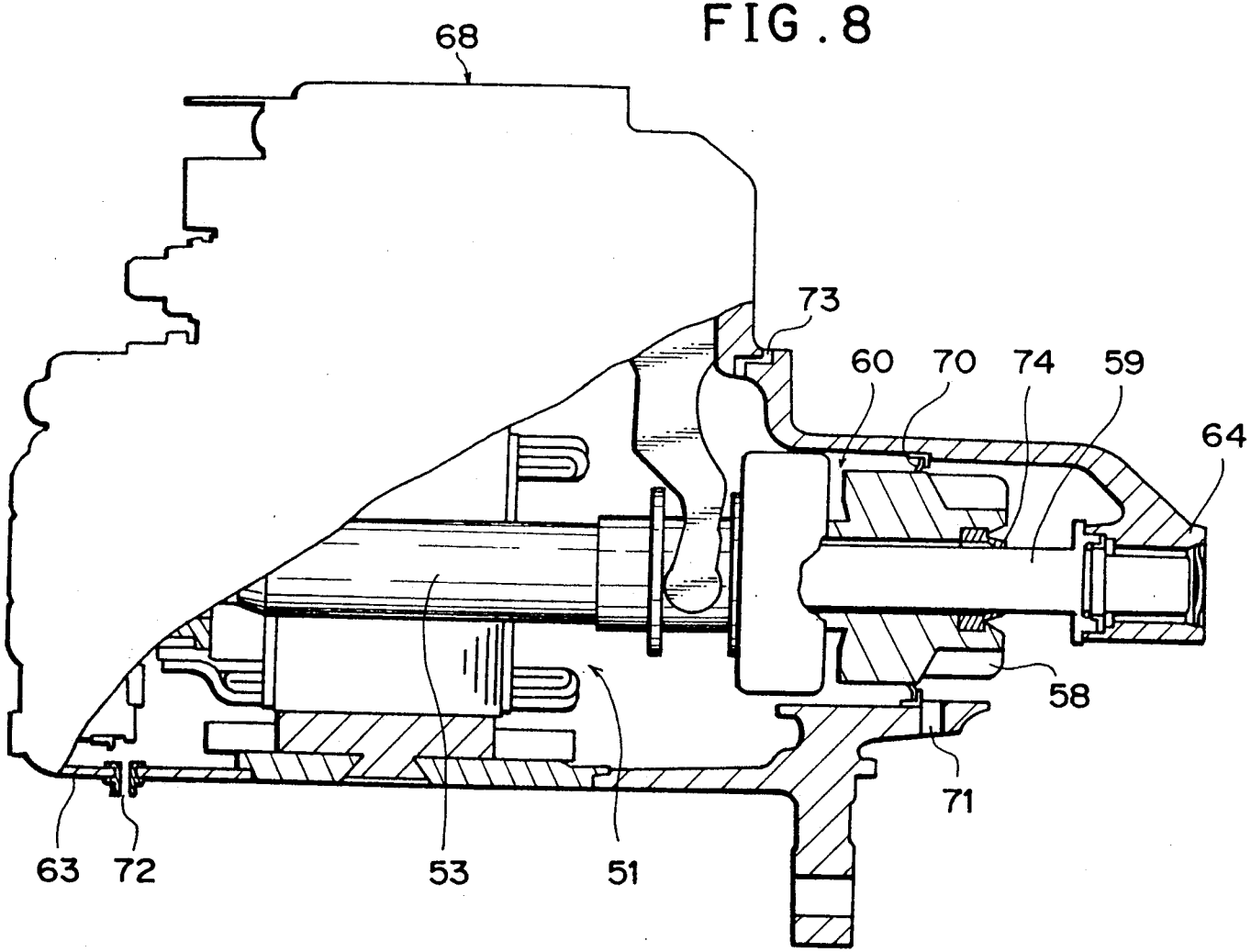
FIG. 8 is an axial sectional view of another modification to the starter motor of FIG. 5.

Referring now to FIG. 8, there is shown another modification to the starter motor of the embodiment shown in FIG. 5. The modified starter motor is different in construction from the starter motor of the second embodiment in that an oil seal 74 for sealing the output rotary shaft 59 is additionally provided on an inner periphery of the pinion 58.

Thus, the modified starter motor exhibits, in addition to the effects of the starter motor of the second embodiment shown in FIG. 5, an effect that the effect of preventing admission of water into the inside of the outer casing is further improved by the oil seal 74.

Figure 9:
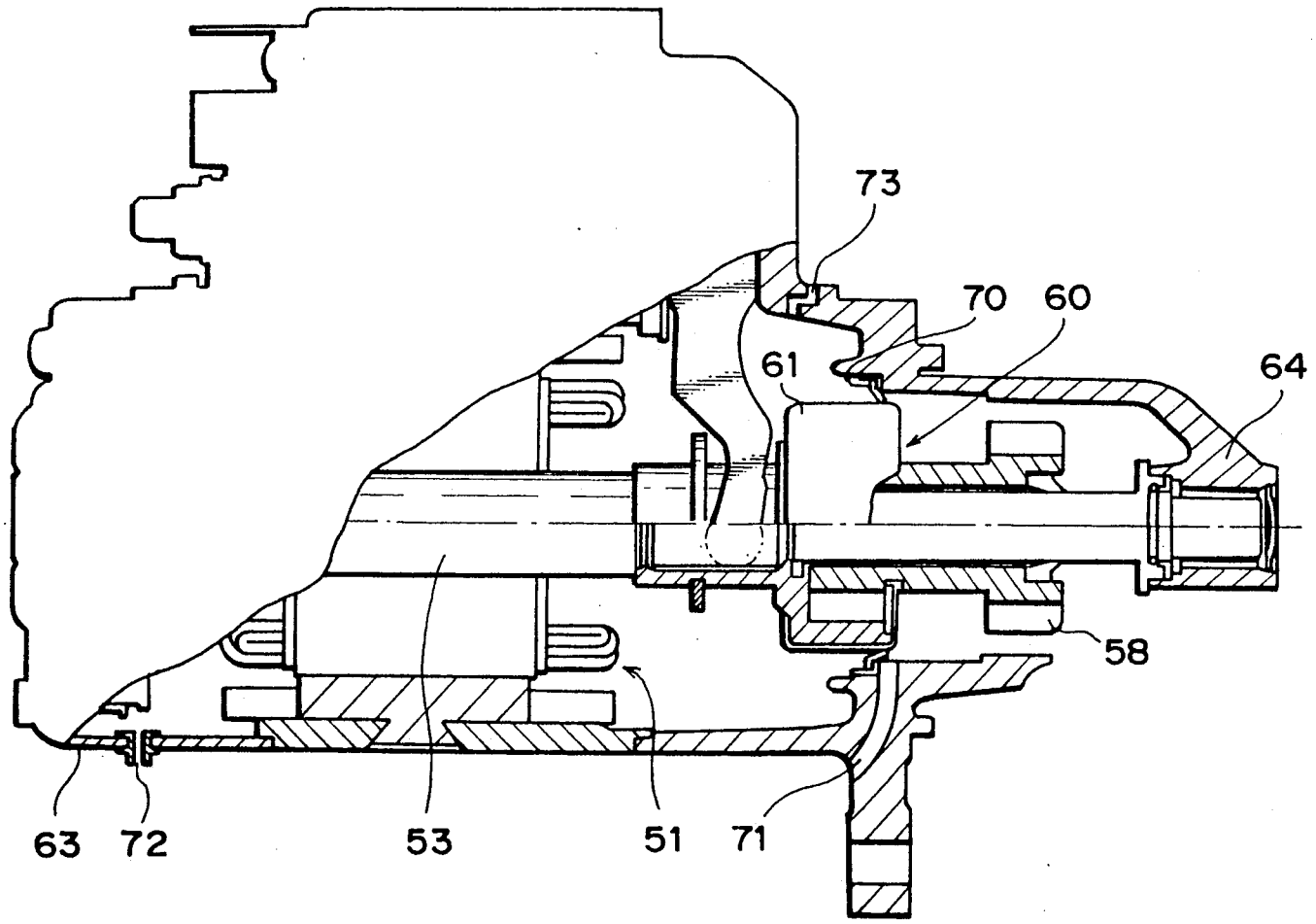
FIG. 9 is a similar view but showing a further modification to the starter motor of FIG. 5.

Referring now to FIG. 9, there is shown a further modification to the starter motor of the embodiment shown in FIG. 5. The modified starter motor is different from the starter motor of the second embodiment in that the oil seal 70 is mounted in normal contact with an outer periphery of the clutch outer member 61 of the overrunning clutch device 60. The starter motor thus exhibits similar effects to those of the starter motor of the second embodiment described hereinabove.

In summary, the starter motor of the second embodiment and the modified starter motors include an oil seal for closing a gap between an outer periphery of an overrunning clutch and an outer casing which has at least two communicating holes formed therein for the communication with the atmospheric air outside the outer casing, one of the communicating holes being formed at a lower portion of the outer casing in such a manner as to be directed downwardly.

It is to be noted that preferably the communicating hole 73 for the communication with the outside atmospheric air is formed above the water drain hole 72 and at a location as high as possible with respect to the motor body 51 of the dc motor. Further, the communicating hole 73 need not be formed in the front bracket 64 but may be formed otherwise in the yoke 57 or the rear bracket 63.

Further, preferably the water drain hole 72 has a greater sectional area than the communicating hole 73 for the communication with the outside atmospheric air so that a ratio of water which is discharged from within the inside of the starter motor may be greater than that of water which may be admitted into the inside of the starter motor.

Having now fully described the invention, it will be apparent to one of ordinary skill in the art that many changes and modifications can be made thereto without departing from the spirit and scope of the invention as set forth herein.

What is claimed is:

1. A starter motor for starting an engine, comprising a casing including a front bracket and a rear bracket, an output rotary shaft mounted for rotation in said casing, an electric motor accommodated in said casing for rotating said output rotary shaft, a bearing mounted on said front bracket, said front bracket having an opening formed therein, a pinion moving member mounted for rotation and for axial sliding movement on said output rotary shaft and supported at an outer periphery thereof for axial sliding movement on said bearing and also for rotation within said front bracket by way of said bearing, said pinion moving member extending outwardly through said opening of said front bracket, an overrunning clutch for coupling said output rotary shaft to said pinion moving member, said pinion moving member having a pinion formed at a front end portion thereof such that, when said pinion moving member is moved outwardly in an axial direction from its rest position, said pinion is operatively coupled to said engine to start said engine, an annular seal member mounted in said opening of said front bracket and extending radially inwardly and generally axially outwardly from said front bracket to form a lip portion, and a flange member securely mounted on said outer periphery of said pinion moving member such that, when said pinion moving member is at its rest position, said lip portion of said annular seal member contacts with said flange member to close said opening of said front bracket, said rear bracket having a water drain hole formed at a location thereof opposite to said opening of said front bracket for discharging water from the inside of said casing, said casing having an atmosphere communicating hole formed at a suitable location thereof for preventing admission of water into the inside of said casing but permitting passage only of air therethrough.

2. A starter motor as claimed in claim 1, wherein said flange member has a channel-shaped cross section, and when said pinion moving member is at its rest position, said lip portion of said annular seal member extends into the inside and contacts with an inner bottom face of the channel-shape of said flange member.

3. A starter motor as claimed in claim 1, wherein said starter motor is mounted in a vertical orientation wherein said output rotary shaft extends in a vertical direction with said pinion positioned upwardly, and said atmosphere communicating hole is opened downwardly at an outer face of said front bracket.

4. A starter motor for starting an engine, comprising a casing including a front bracket and a rear bracket, an output rotary shaft mounted for rotation in said casing, an electric motor accommodated in said casing for rotating said output rotary shaft, a bearing mounted on said front bracket, said front bracket having an opening formed therein, a pinion moving member mounted for rotation and for axial sliding movement on said output rotary shaft and supported at an outer periphery thereof for axial sliding movement on said bearing and also for rotation within said front bracket by way of said bearing, said pinion moving member extending outwardly through said opening of said front bracket, an overrunning clutch for coupling said output rotary shaft to said pinion moving member, said pinion moving member having a pinion formed at a front end portion thereof such that, when said pinion moving member is moved outwardly in an axial direction from its rest position, said pinion is operatively coupled to said engine to start said engine, and an annular seal member mounted in said opening of said front bracket and extending radially inwardly to form a lip portion which is held in normal contact with said outer periphery of said pinion moving member, said rear bracket having a water drain hole formed at a location thereof opposite to said opening of said front bracket for discharging water from the inside of said casing, said casing having an atmosphere communicating hole, distinct from said water drain hole, formed at a suitable location thereof and configured to prevent the admission of water into the inside of said casing through said hole but permitting the free passage of air therethrough.

5. A starter motor as claimed in claim 4, wherein said starter motor is mounted in a vertical orientation wherein said output rotary shaft extends in a vertical direction with said pinion positioned upwardly, and said atmosphere communicating hole is disposed in said front bracket and opens downwardly at an outer face thereof.

6. A starter motor for starting an engine, comprising a casing including a front bracket and a rear bracket, an output rotary shaft mounted for rotation in said casing, said starter motor being mounted on said engine in a vertical orientation wherein said output rotary shaft extends in a vertical direction and said front and rear brackets are positioned upwardly and downwardly, respectively, an electric motor accommodated in said casing for rotating said output rotary shaft and having a yoke which serves as part of said casing, a pinion moving member mounted for rotation and for axial sliding movement on said output rotary shaft and also in said front bracket and having a pinion formed at an outer end portion thereof, an overrunning clutch for coupling said output rotary shaft to said pinion moving member, a shift lever mounted at a supporting portion of said front bracket in said casing for moving said pinion moving member in opposite axial directions, an electromagnetic switch located in a juxtaposed relationship with said electric motor in said casing for controlling energization of said electric motor and operating said shift lever to move said pinion moving member axially to and from a position in which said pinion thereof is operatively coupled to said engine to start said engine, a seal member (41) for closing a gap between an outer periphery of said overrunning clutch and said front bracket, said rear bracket having a water drain hole formed at a lower portion thereof such that water may be discharged downwardly through said water drain hole, said front bracket defining juxtaposed annular portions (44, 45) having interposed portions (46) exposed to the external atmosphere, and a communicating groove (42) formed in an end face of said front bracket adjacent said supporting portion and extending between said annular portions through one of said interposed portions such that the inside and the outside of said annular portions are communicated with each other and with the external atmosphere by said communicating groove.

7. A starter motor for starting an engine, comprising a casing, an output rotary shaft mounted for rotation in said casing, an electric motor accommodated in said casing for rotating said output rotary shaft, a pinion moving member mounted for rotation and for axial sliding movement on said output rotary shaft and also in said front bracket and having a pinion formed at an outer end portion thereof, an overrunning clutch accommodated in said casing for coupling said output rotary shaft to said pinion moving member, an electromagnetic switch for controlling energization of said electric motor and moving said pinion moving member axially to and from a position in which said pinion of said pinion moving member is operatively coupled to said engine to start said engine, and a seal member for closing a gap between an outer periphery of said overrunning clutch and said casing, said casing having at least two communicating holes formed therein for the communication with the atmospheric air outside said casing, one of said communicating holes being formed at a lower portion of said casing in such a manner as to be directed downwardly, and at least another one of said communicating holes being formed at an upwardly spaced portion of said casing from the downwardly directed communicating hole to facilitate draining of water from within said casing through the downwardly directed communicating hole by providing a passage for the entry of displacement air.

8. A starter motor as claimed in claim 7, wherein said pinion moving member serves as a clutch inner member of said overrunning clutch, and said seal member is interposed between an outer periphery of said pinion moving member and said casing.

9. A starter motor as claimed in claim 7, wherein said pinion moving member serves as a clutch inner member of said overrunning clutch, and said seal member is interposed between an outer periphery of a clutch outer member of said overrunning clutch and said casing.

10. A starter motor as claimed in claim 7, further comprising an additional seal member interposed between an inner periphery adjacent an outer end of said pinion of said pinion moving member and an outer periphery of said output rotary shaft.

* * * * *